US008127504B2

(12) United States Patent
McDaniel

(10) Patent No.: US 8,127,504 B2
(45) Date of Patent: Mar. 6, 2012

(54) SLIDING DOOR ASSEMBLY FOR AIR AND WATER EXCLUSION

(75) Inventor: Kyle A. McDaniel, Johns Creek, GA (US)

(73) Assignee: Alcoa Inc., Pittsburgh, PA (US)

( * ) Notice: Subject to any disclaimer, the term of this patent is extended or adjusted under 35 U.S.C. 154(b) by 527 days.

(21) Appl. No.: 12/366,072

(22) Filed: Feb. 5, 2009

(65) Prior Publication Data

US 2010/0192467 A1 Aug. 5, 2010

(51) Int. Cl.
*E05D 15/12* (2006.01)

(52) U.S. Cl. ..... 52/207; 49/504

(58) Field of Classification Search ..... 52/207, 52/210, 204.51; 49/504
See application file for complete search history.

(56) References Cited

U.S. PATENT DOCUMENTS

| | | | | | |
|---|---|---|---|---|---|
| 2,847,726 | A | * | 8/1958 | Frick | 52/207 |
| 3,420,026 | A | * | 1/1969 | Nolan | 52/204.51 |
| 3,851,420 | A | | 12/1974 | Tibbetts | 49/471 |
| 4,262,450 | A | * | 4/1981 | Anderson | 49/425 |
| 4,437,266 | A | * | 3/1984 | Keller | 49/493.1 |
| 4,488,387 | A | | 12/1984 | Foti | 52/207 |
| 4,594,812 | A | * | 6/1986 | Clancy et al. | 49/404 |
| 4,667,441 | A | * | 5/1987 | Coddens | 49/404 |
| 4,815,246 | A | * | 3/1989 | Haas | 52/207 |
| 4,891,921 | A | | 1/1990 | Governate | 52/207 |
| 5,575,321 | A | * | 11/1996 | Currier | 160/90 |
| 5,687,508 | A | | 11/1997 | Fitzhenry, Jr. et al. | 49/471 |
| 5,870,859 | A | | 2/1999 | Kitada | 49/404 |
| 6,199,331 | B1 | * | 3/2001 | Hunt | 52/207 |
| 6,490,832 | B1 | * | 12/2002 | Fischbach et al. | 52/207 |
| 6,871,448 | B1 | * | 3/2005 | Kline | 49/319 |
| 7,150,130 | B2 | * | 12/2006 | Kobayashi et al. | 52/210 |
| 7,246,466 | B2 | * | 7/2007 | Turner | 49/504 |
| 7,266,929 | B1 | * | 9/2007 | Allred et al. | 52/211 |
| 7,845,125 | B2 | * | 12/2010 | Lambertini | 52/207 |
| 7,930,856 | B2 | * | 4/2011 | Hooper, Jr. | 49/411 |
| 2007/0151179 | A1 | * | 7/2007 | Speyer et al. | 52/207 |
| 2008/0092463 | A1 | | 4/2008 | Poirier et al. | 52/204.5 |
| 2009/0031635 | A1 | * | 2/2009 | Davis | 49/478.1 |

* cited by examiner

*Primary Examiner* — Katherine W Mitchell
*Assistant Examiner* — Justin Rephann
(74) *Attorney, Agent, or Firm* — Greenberg Traurig, LLP

(57) ABSTRACT

A sliding door assembly includes a fixed meeting stile sufficiently designed for maintaining a vertical weather strip gasket; a door jamb sufficiently designed for maintaining a vertical weather strip gasket; a first horizontal weather bar comprising an attaching means for engaging a sill of the sliding door assembly, and a horizontal member having a first end for engaging the fixed meeting stile, and a second end for engaging the door jamb, wherein the horizontal member is sufficiently designed for maintaining a horizontal weather strip gasket; and a second horizontal weather bar comprising an attaching means for engaging a head component of the sliding door assembly, and a horizontal member having a first end for engaging the fixed meeting stile, and a second end for engaging the door jamb, wherein the horizontal member is sufficiently designed for maintaining a horizontal weather strip gasket.

12 Claims, 12 Drawing Sheets

SLIDING DOOR ASSEMBLY FOR AIR AND WATER EXCLUSION

BACKGROUND

Sliding door assemblies typically include a sliding door moveable between a closed position and an open position, a stationary door maintained in a stationary position, and a door frame surrounding and supporting the sliding door and the stationary door. A common problem with known sliding door assemblies is that they are not nearly as airtight and weatherproof as desired. While the stationary doors of such structures are readily securable weather tightly in their frames, the sliding doors pose a sealing problem which has long persisted.

SUMMARY

Sliding door assemblies for air and water exclusion are disclosed herein. According to an embodiment of the present invention, there is disclosed a sliding door assembly that includes a fixed meeting stile having an outer surface sufficiently designed for maintaining at least one vertical weather strip gasket; a door lock jamb having a side surface sufficiently designed for maintaining at least one vertical weather strip gasket; a first horizontal weather bar comprising an attaching means for engaging a sill of the sliding door assembly, and a horizontal member having a first end for engaging the outer surface of the fixed meeting stile, and a second end for engaging the side surface of the door lock jamb, wherein the horizontal member of the first horizontal weather bar is sufficiently designed for maintaining at least one horizontal weather strip gasket; and a second horizontal weather bar comprising an attaching means for engaging a head component of the sliding door assembly, and a horizontal member having a first end for engaging the outer surface of the fixed meeting stile, and a second end for engaging the side surface of the door lock jamb, wherein the horizontal member of the second horizontal weather bar is sufficiently designed for maintaining at least one horizontal weather strip gasket.

According to an embodiment of the present invention, there is disclosed a sliding door assembly that includes a head component including an operable head and a fixed head; a bottom sill component including an operable sill and a fixed sill, wherein at least a portion of the fixed sill has a threshold sufficiently designed to engage a horizontal weather bar, wherein the horizontal weather bar comprises: an attaching means for engaging the threshold, a horizontal member, and at least one horizontal weather strip gasket engaging the horizontal member; a fixed meeting stile engaging the head component and the bottom sill component, wherein a side of the fixed meeting stile maintains a fixed panel door, wherein an outer surface of the fixed meeting stile is sufficiently designed to engage the horizontal member of the horizontal weather bar such that at least a portion of the horizontal member overlaps the fixed meeting stile, and wherein the outer surface of the fixed meeting stile is sufficiently designed to engage a vertical weather strip gasket such that the vertical weather strip gasket and the horizontal weather strip gasket of the horizontal weather bar form a protective seal; a door lock jamb for engaging a door stile of a moveable door; and a fixed jamb for maintaining one side of the fixed panel door.

According to an embodiment of the present invention, there is disclosed a sliding door assembly that includes a head component including an operable head and a fixed head; a bottom sill component including an operable sill and a fixed sill; a horizontal weather bar comprising: an attaching means for engaging directly or indirectly with the fixed sill; a horizontal member; and at least one horizontal weather strip gasket engaging the horizontal member; a fixed meeting stile engaging the head component and the bottom sill component and including a fixed stile and a moveable stile, wherein a side of the fixed stile maintains a fixed panel door, wherein an outer surface of the fixed meeting stile is sufficiently designed to engage the horizontal member of the horizontal weather bar such that at least a portion of the horizontal member overlaps the fixed meeting stile, wherein the fixed meeting stile is sufficiently designed to engage a vertical weather strip gasket such that the vertical weather strip gasket and the horizontal weather strip gasket of the horizontal weather bar form a protective seal, and wherein the moveable stile maintains one side of a sliding panel door; a door lock jamb for engaging a door stile of the sliding panel door, wherein the door lock jamb is sufficiently designed to engage at least a portion of the horizontal member of the horizontal weather bar, and wherein the door lock jamb is sufficiently designed to engage a vertical weather strip gasket such that the vertical weather strip gasket and the horizontal weather strip gasket of the horizontal weather bar form a protective seal; and a fixed jamb for maintaining one side of the fixed panel door.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

FIG. 1A is a top plan view of the fixed meeting stile. FIG. 1B is an isometric view of the fixed meeting stile;

FIG. 2A is a top plan view of the door lock jamb. FIG. 2B is an isometric view of the door lock jamb;

FIG. 5A is a fragmentary isometric view of the fixed meeting stile and the horizontal weather bar from the front. FIG. 5B is a fragmentary isometric view of the fixed meeting stile and the horizontal weather bar from the back;

FIG. 6A is a fragmentary isometric view of the fixed meeting stile and the horizontal weather bar from the front. FIG. 6B is a fragmentary isometric view of the fixed meeting stile and the horizontal weather bar from the back;

FIG. 7A shows the sliding door assembly prior to positioning of weather strip gaskets. FIG. 7B shows the sliding door assembly after positioning the weather strip gaskets;

FIG. 8A is a top plan view of the fixed meeting stile. FIG. 8B is an isometric view of the fixed meeting stile;

FIG. 9A is a top plan view of the door lock jamb. FIG. 9B is an isometric view of the door lock jamb;

FIG. 10A is a fragmentary isometric view of the fixed meeting stile and the horizontal weather bar from the front. FIG. 10B is a fragmentary isometric view of the fixed meeting stile and the horizontal weather bar from the back;

FIG. 11A is a fragmentary isometric view of the fixed meeting stile and the horizontal weather bar from the front. FIG. 11B is a fragmentary isometric view of the fixed meeting stile and the horizontal weather bar from the back;

FIG. 12A shows the sliding door assembly prior to positioning of weather strip gaskets. FIG. 12B shows the sliding door assembly after positioning the weather strip gaskets.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the present invention.

DETAILED DESCRIPTION

Sliding door assemblies for air and water exclusion re disclosed herein.

As used herein, the terms "fixed meeting stile" or "meeting stile" refer to the vertical portion of a door frame that includes a fixed stile engaging a stationary door and a fixed vertical hook engaging a moveable door.

As used herein, the term "door lock jamb" refers to the vertical portion of a door frame onto which a door is secured.

As used herein, the term "weather strip gasket" refers to a material or device used to prevent rain and water from entering a sliding door assembly by either blocking it outright or by blocking most of it and returning or rerouting it. A secondary goal of a weather-strip gasket may be to keep interior air in, thus saving energy with heating and air conditioning.

As used herein, the term "weather bar" refers to a device of the present invention used to help seal an opening. In an embodiment, the opening may exist between a threshold or sill and a door lock jamb. In an embodiment, the opening may exist between a threshold or sill and a fixed meeting stile. In an embodiment, the opening may exist between a head component and a door lock jamb. In an embodiment, the opening may exist between a head component and a fixed meeting stile. Weather bars of the present invention typically include one or more weather strip gaskets.

As used herein, the term "channel" refers to an opening, groove, notch or relief for accepting a weather strip gasket.

As used herein, the term "water and air infiltration" refers to the ability of water and/or air to move into an interior space.

As used herein, the term "engage", "engaging" or "engaged" refers to contacting or to make contact with something.

As used herein, the term "protective seal" refers to the ability of a sliding door assembly of the present invention to prevent water and air infiltration.

Figure 1B:
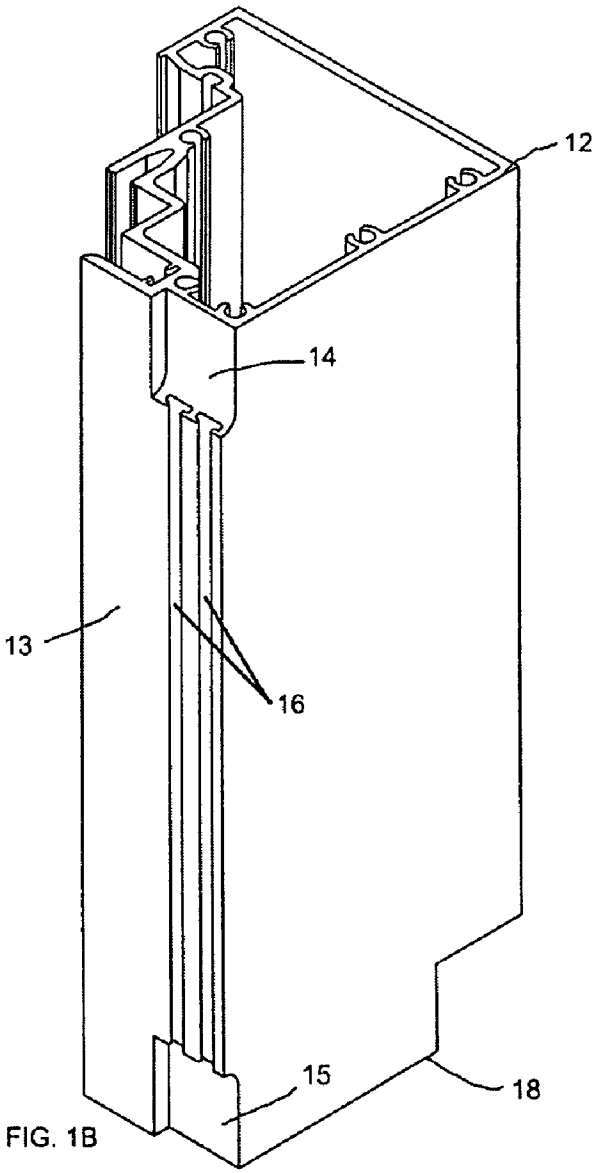
FIGS. 1A and 1B illustrate an embodiment of a fixed meeting stile of the present invention.
Figure 1A:
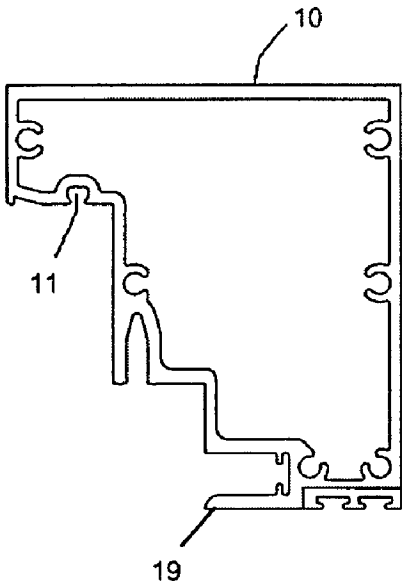

FIGS. 1A and 1B illustrate an embodiment of a fixed meeting stile 10 of the present invention. FIG. 1A is a top plan view of the fixed meeting stile 10. FIG. 1B is an isometric view of the fixed meeting stile 10. The fixed meeting stile 10 would typically be connected to a door stile of a stationary glass door panel (not shown) at location 11 using means known in the art. The fixed meeting stile 10 includes a head end 12 for connecting with a head component of a sliding door assembly, a sill end 18 for connecting with a sill component of a sliding door assembly, and a vertical axis therebetween. In the embodiments shown in FIGS. 1A and 1B, the fixed meeting stile 10 includes an outer surface 13 having a recessed area 14 at the head end 12, a recessed area 15 at the sill end 18, and two channels 16 running vertically between recessed areas 14 and 15. The channels 16 are sufficiently designed to maintain vertical weather strip gaskets (not shown in FIG. 1A or 1B). Tongue 19 is adapted to overlap and interlock with a mating tongue on an operable meeting stile of a moveable (sliding) door when the sliding door is in a closed position.

Figure 2B:
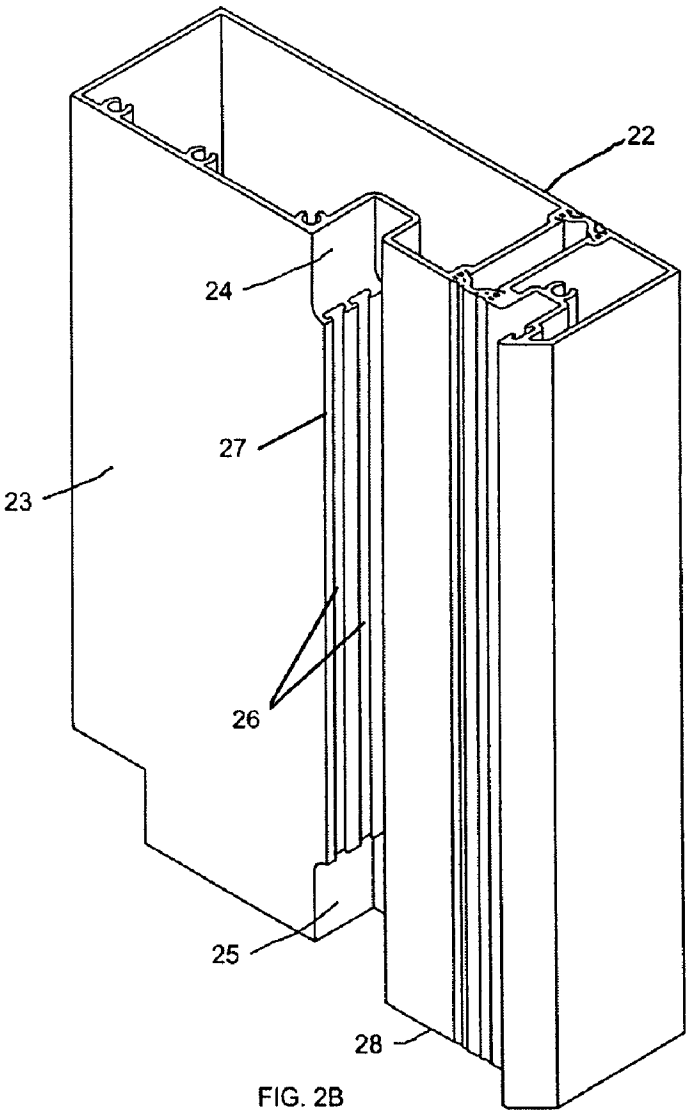
FIGS. 2A and 2B illustrate an embodiment of a door lock jamb of the present invention.
Figure 2A:
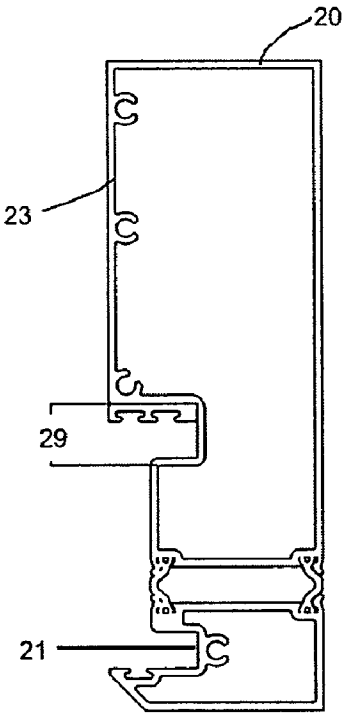

FIGS. 2A and 2B illustrate an embodiment of a door lock jamb 20 of the present invention. FIG. 2A is a top plan view of the door lock jamb 20. FIG. 2B is an isometric view of the door lock jamb 20. The door lock jamb 20 includes a head end 22 for connecting with a head component of a sliding door assembly, a sill end 28 for connecting with a sill component of a sliding door assembly, and a vertical axis therebetween. In the embodiments shown in FIGS. 2A and 2B, the door lock jamb 20 includes a side surface 23 with section 29 having a surface 27. Surface 27 includes a recessed area 24 at the head end 22, a recessed area 25 at the sill end 28, and two channels 26 running vertically between recessed areas 24 and 25. The channels 26 are sufficiently designed to maintain vertical weather strip gaskets (not shown in FIG. 2A or 2B).

Figure 3:
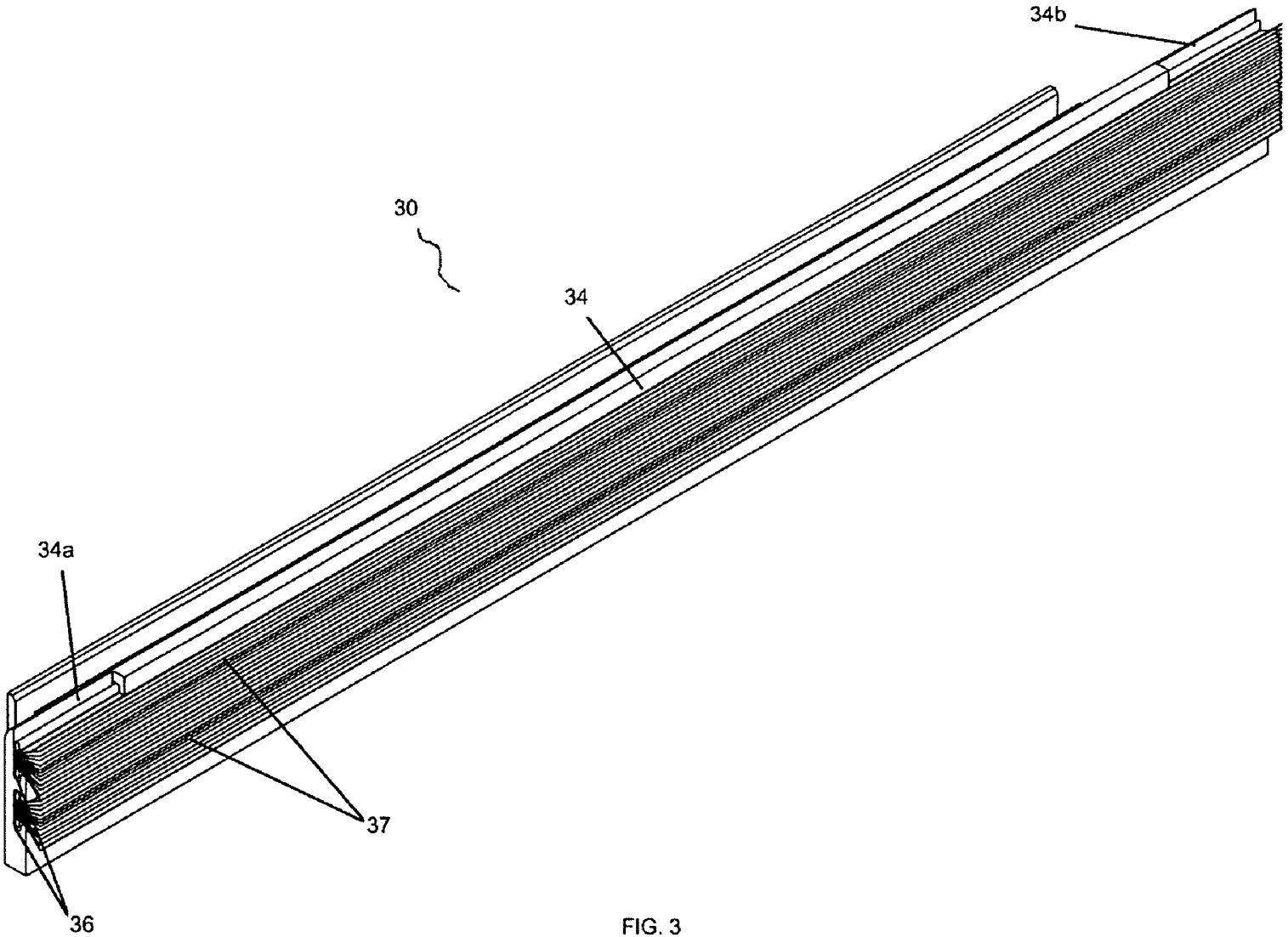
FIG. 3 is a front isometric view illustrating an embodiment of a horizontal weather bar of the present invention.
Figure 4:
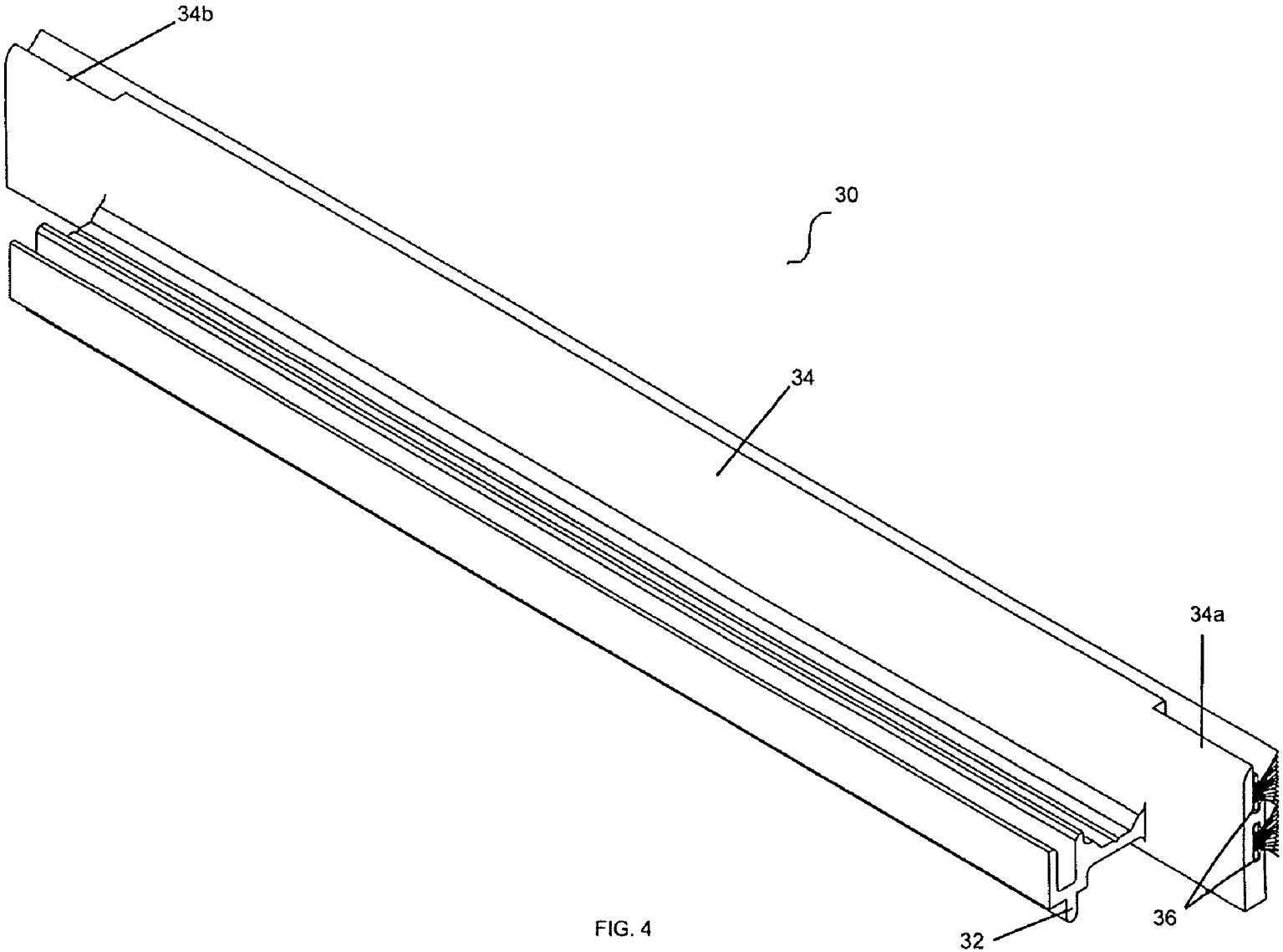
FIG. 4 is a back isometric view of the horizontal weather bar of FIG. 3.

FIGS. 3 and 4 illustrate an embodiment of a horizontal weather bar 30 of the present invention. FIG. 3 is a front isometric view of the horizontal weather bar 30, and FIG. 4 is a back isometric view of the horizontal weather bar 30. The horizontal weather bar 30 includes a horizontal member 34, and attaching means 32 for engaging one of a sill, a threshold, or a head component of a sliding door assembly. The horizontal member 34 includes a first coped end 34*a*, a second coped end 34*b*, and a horizontal axis therebetween. In an embodiment, when the horizontal weather bar 30 engages a sill of a sliding door assembly, the first coped end 34*a* is capable of engaging and overlapping an outer surface of a fixed meeting stile of the present invention, and the second coped end 34*b* is capable of engaging and overlapping a side surface of a door lock jamb of the present invention. In an embodiment, when the horizontal weather bar 30 engages a head component of a sliding door assembly, the second coped end 34*b* is capable of engaging and overlapping an outer surface of a fixed meeting stile of the present invention, and the first coped end 34*a* is capable of engaging and overlapping a side surface of a door lock jamb of the present invention. Along the horizontal axis of the horizontal member 34, there are horizontal channels 36 for maintaining horizontal weather strip gaskets 37.

Figure 5B:
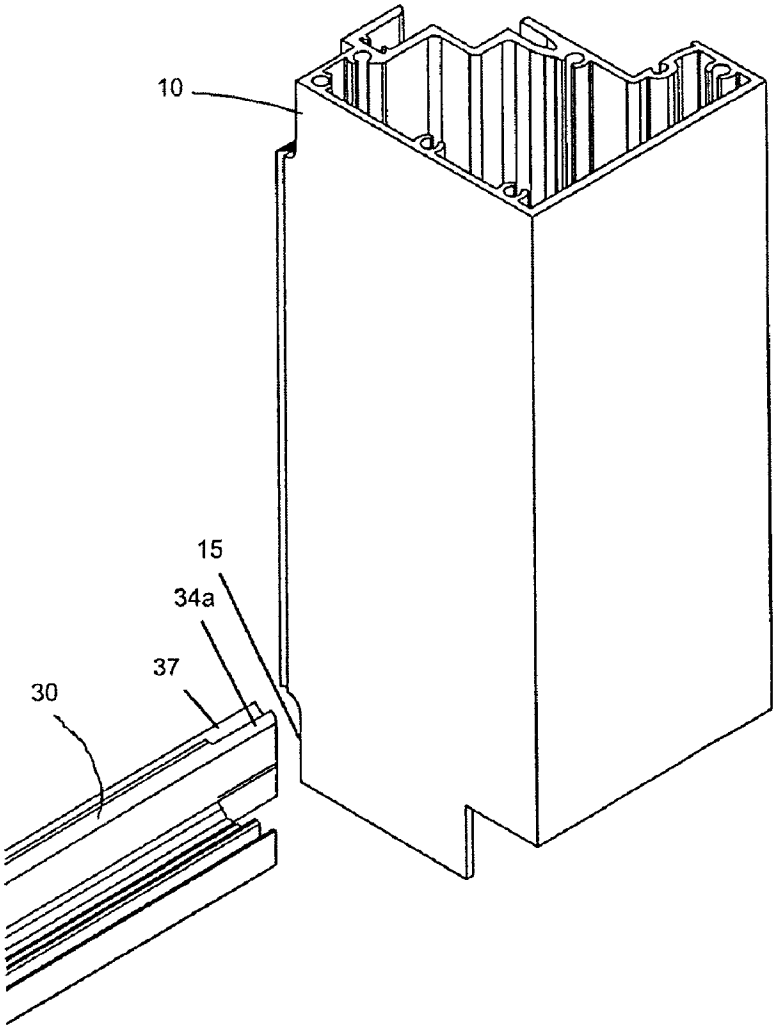
FIGS. 5A and 5B illustrate fragmentary isometric views of the fixed meeting stile of FIG. 1B and the horizontal weather bar of FIG. 3 prior to engaging the horizontal weather bar and the fixed meeting stile.
Figure 5A:
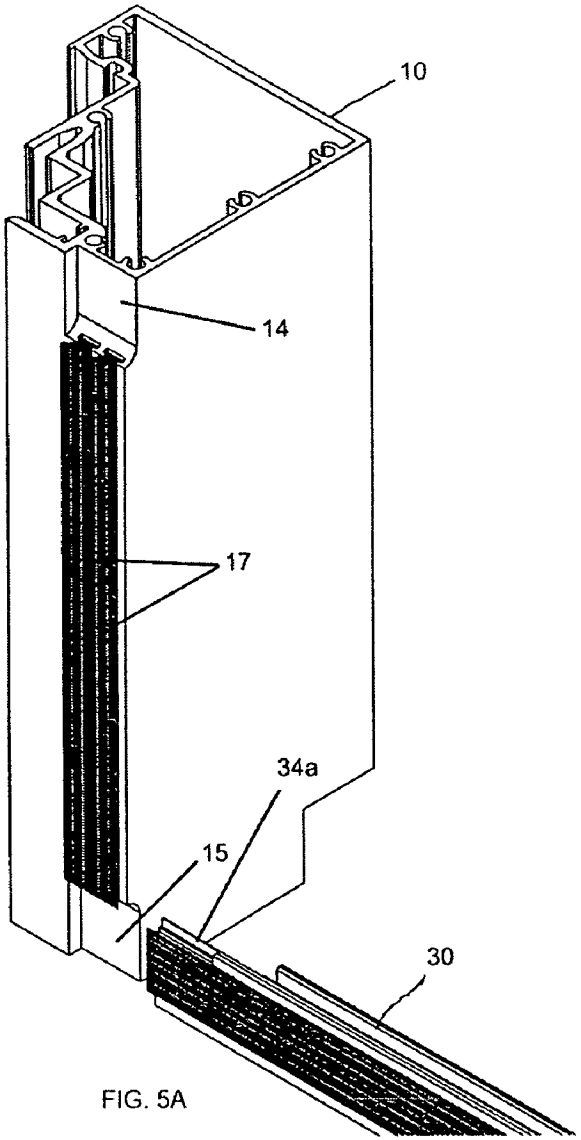
Figure 6B:
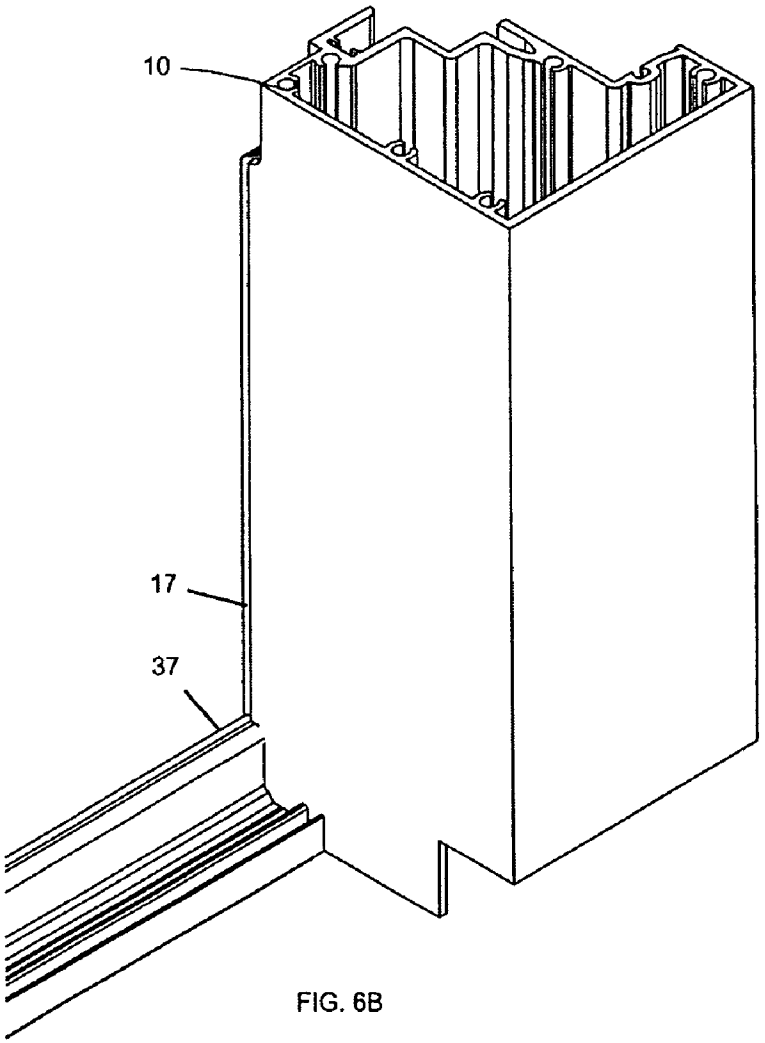
FIGS. 6A and 6B illustrate fragmentary isometric views of the fixed meeting stile of FIG. 1B and the horizontal weather bar of FIG. 3 after engaging the horizontal weather bar and the fixed meeting stile.
Figure 6A:
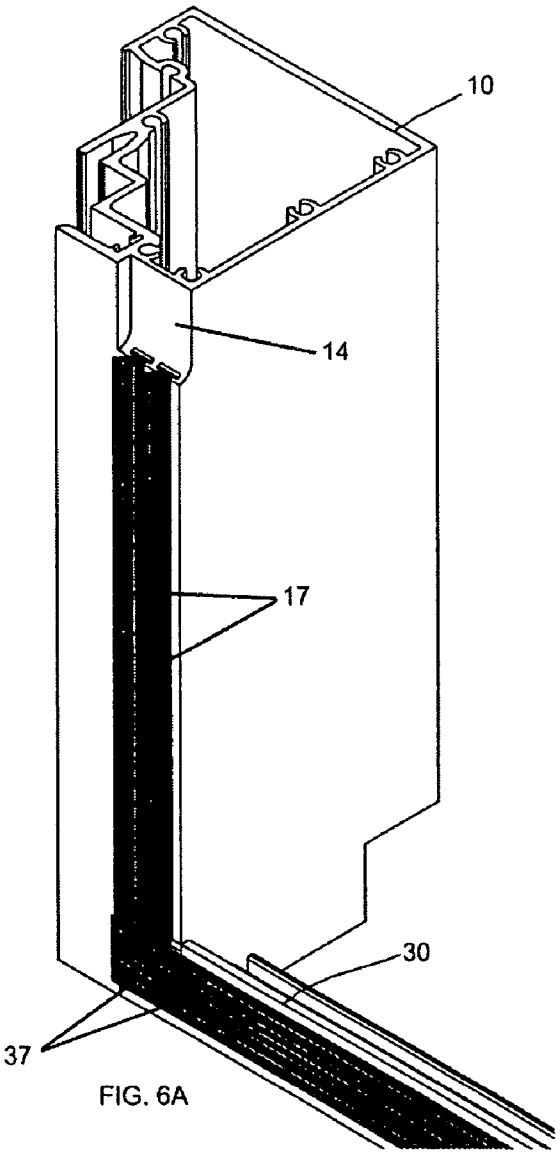

FIGS. 5A and 5B, in conjunction with FIGS. 6A and 6B, illustrate the engagement of the fixed meeting stile 10 and the horizontal weather bar 30. As illustrated in the various figures, vertical weather strip gaskets 17 and horizontal weather strip gaskets 37 are positioned, respectively, in the fixed meeting stile 10 and the horizontal weather bar 30. FIG. 5A is a fragmentary isometric view of the fixed meeting stile 10 and the horizontal weather bar 30 from the front prior to engagement. FIG. 5B is a fragmentary isometric view of the fixed meeting stile 10 and the horizontal weather bar 30 from the back prior to engagement. FIG. 6A is a fragmentary isometric view of the fixed meeting stile 10 and the horizontal weather bar 30 from the front after engagement. FIG. 6B is a fragmentary isometric view of the fixed meeting stile 10 and the horizontal weather bar 30 from the back after engagement. When vertical weather strip gaskets 17 are positioned within the channels 16 of the fixed meeting stile 10, and when horizontal weather strip gaskets 37 are positioned within the channels 36 of the horizontal weather bar 30, the vertical weather strip gaskets 17 will abut the top horizontal weather strip gasket 37 forming a protective seal, as illustrated in FIGS. 6A and 6B. In an embodiment, the abutting of the vertical weather strip gaskets 17 and horizontal weather strip gaskets 37 creates a wick-free environment. The ends of the vertical weather strip gaskets 17 will not extend past the horizontal weather strip gaskets 37, thus stopping the possibility of water wicking up the vertical weather strip gaskets 17.

Figure 7B:
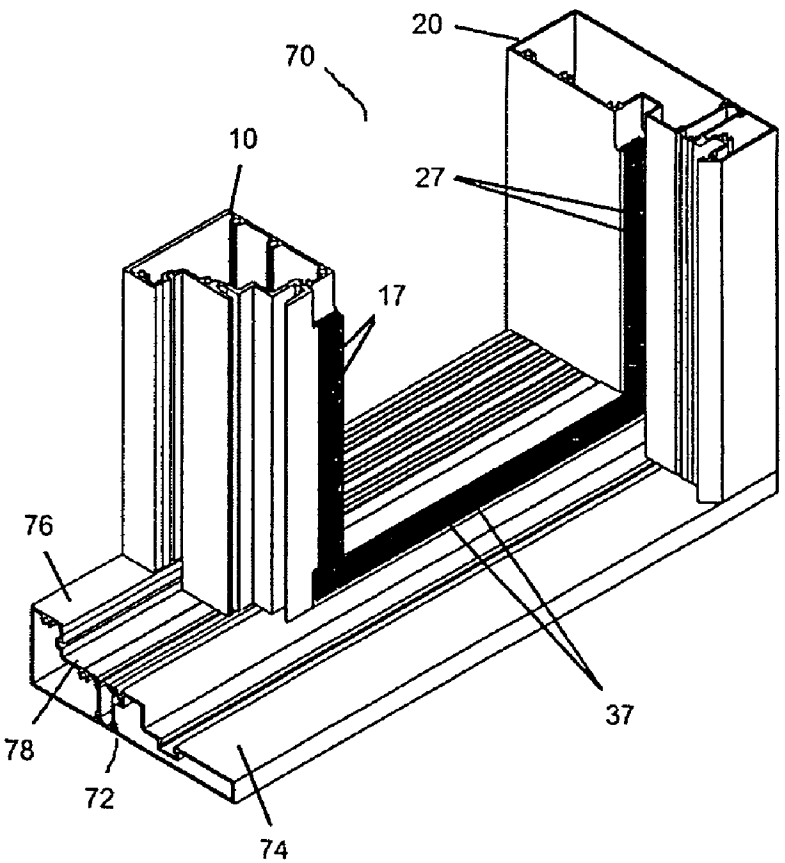
FIGS. 7A and 7B illustrate fragmentary isometric views of an embodiment of a sliding door assembly of the present invention incorporating the fixed meeting stile of FIG. 1B, the door lock jamb of FIG. 2B, and the horizontal weather bar of FIG. 3.
Figure 7A:
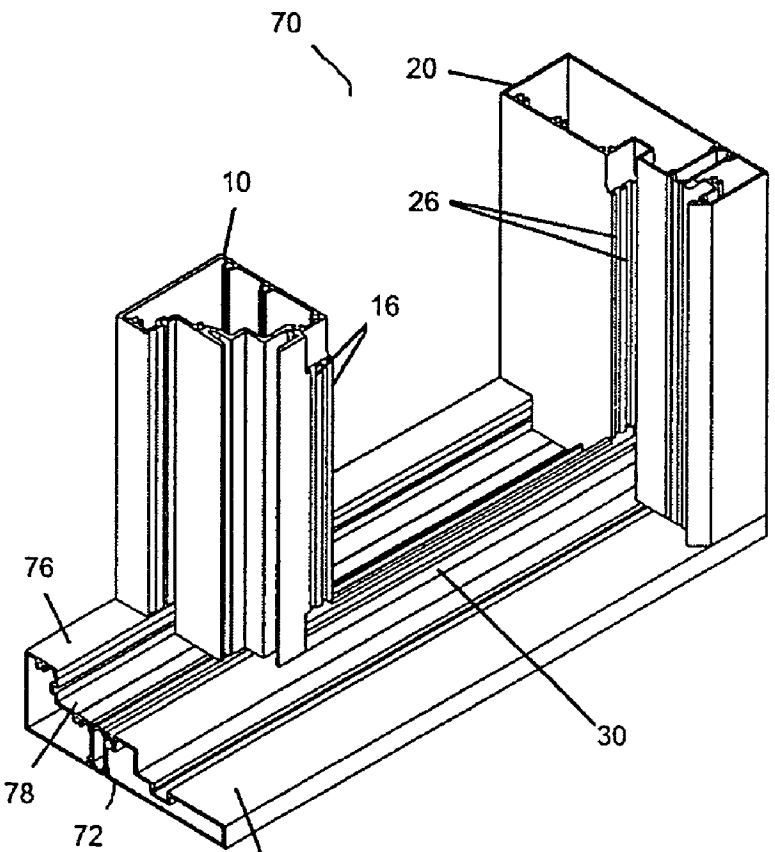

FIGS. 7A and 7B are fragmentary isometric views of a sliding door assembly 70 of the present invention featuring the fixed meeting stile 10, the door lock jamb 20, and the horizontal weather bar 30. FIG. 7A shows the meeting stile 10, the door lock jamb 20, and the horizontal weather bar 30 in position without any weather strip gaskets. FIG. 7B shows the meeting stile 10, the door lock jamb 20, and the horizontal weather bar 30 in position with weather strip gaskets 17 and 37. The sliding door assembly 70 illustrated in FIGS. 7A and 7B have an OX configuration for illustrative purposes only. The fixed meeting stile 10 and the horizontal weather bar 30 of the present invention are not intended to be limited to sliding door units having an OX configuration, as other typical sliding door configurations can be used. The head component of the sliding door assembly 70, as well as the fixed panel door and the sliding panel door are not shown in FIGS. 7A and 7B for simplicity. The sliding door assembly 70 includes a bottom sill component 72 having an operable sill 74 for positioning a moveable door, and a fixed sill 76 for maintaining a stationary door. The fixed sill 76 includes a threshold 78. As illustrated in FIGS. 7A and 7B, the horizontal weather bar 30 engages the threshold 78 via attaching means 32. The sill end 18 of the fixed meeting stile 10 is sufficiently designed to engage the first coped end 34*a* of the first horizontal weather bar 30. The first coped end 34*a* of the first horizontal weather bar 30 overlaps the recessed area 15 of the fixed meeting stile 10. Similarly, the sill end 28 of the door lock jamb 20 is sufficiently designed to engage the second coped end 34*b* of the first horizontal weather bar 30. The second coped end 34*b* of the first horizontal weather bar 30 overlaps the recessed area 25 of the door lock jamb 20. Although not illustrated in FIGS. 7A and 7B, a second horizontal weather bar 30 can engage the head component of the sliding door assembly 70 via attaching means 32, such that the second coped end 34*b* of the second horizontal weather bar 30 overlaps the recessed area 14 at the head end 12 of the fixed meeting stile 10. Similarly, the first coped end 34*a* of the second horizontal weather bar 30 overlaps the recessed area 24 at the head end 22 of the door lock jamb 20. When a sliding door assembly of the present invention includes a first horizontal weather bar having horizontal weather strip gaskets, a second horizontal weather bar having horizontal weather strip gaskets, a fixed meeting stile having vertical weather strip gaskets, and a door lock jamb having vertical weather strip gaskets, a protective seal is created around the periphery of a sliding door.

Figure 8B:
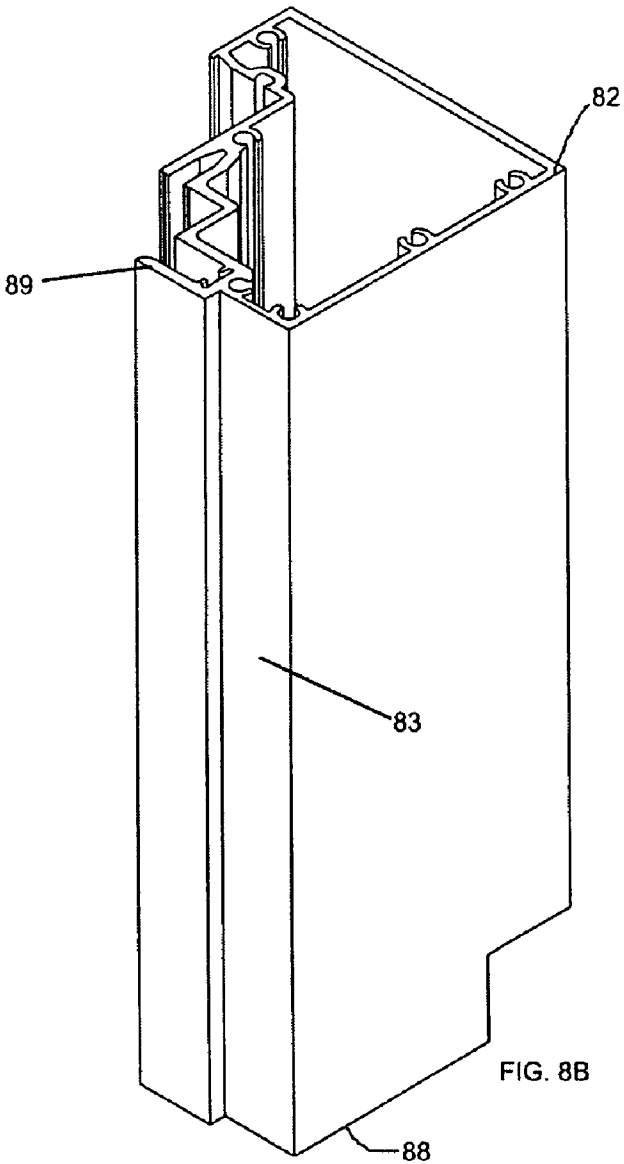
FIGS. 8A and 8B illustrate an embodiment of a fixed meeting stile of the present invention.
Figure 8A:
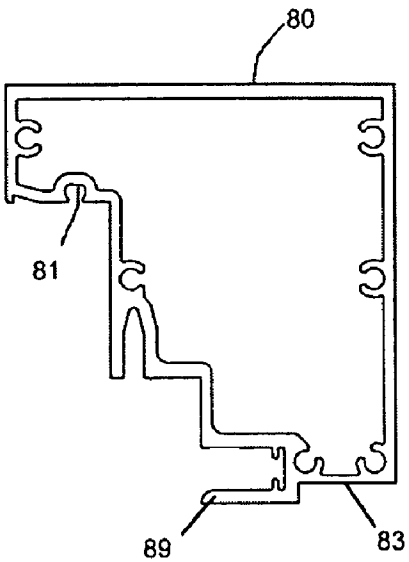

FIGS. 8A and 8B illustrate an embodiment of a fixed meeting stile 80 of the present invention. FIG. 8A is a top plan view of the fixed meeting stile 80. FIG. 8B is an isometric view of the fixed meeting stile 80. The fixed meeting stile 80 would typically be connected to a door stile of a stationary glass door panel (not shown) at location 81 using means known in the art. The fixed meeting stile 80 includes a head end 82 for connecting with a head component of a sliding door assembly, a sill end 88 for connecting with a sill component of a sliding door assembly, and a vertical axis therebetween. In the embodiments shown in FIGS. 8A and 8B, the fixed meeting stile 80 includes an outer surface 83 sufficiently designed for maintaining a vertical weather bar capable of maintaining vertical weather strip gaskets. Tongue 89 is adapted to overlap and interlock with a mating tongue on an operable meeting stile of a moveable (sliding) door when the sliding door is in a closed position. The fixed meeting stile 80 is fabricated such that the outer surface 83 of the meeting stile 80 does not lie flat with the surface of the tongue 89, forming an outer surface 83 capable of holding in place a vertical weather bar (as illustrated, for example, in FIG. 10A). The outer surface 83 is sufficiently designed to engage one of the coped ends of the horizontal weather bar 30.

Figure 9B:
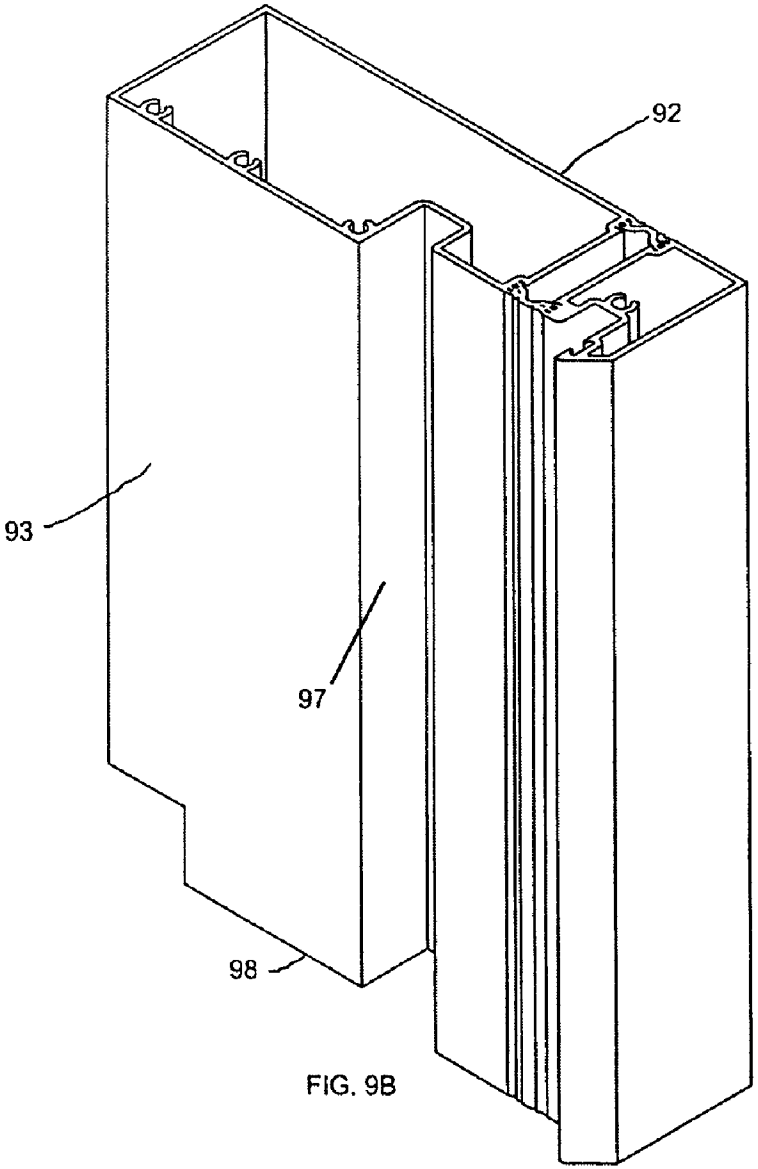
FIGS. 9A and 9B illustrate an embodiment of a door lock jamb of the present invention.
Figure 9A:
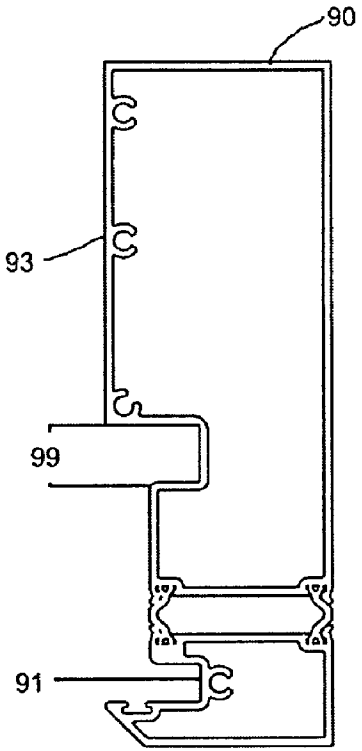

FIGS. 9A and 9B illustrate an embodiment of a door lock jamb 90 of the present invention. FIG. 9A is a top plan view of the door lock jamb 90. FIG. 9B is an isometric view of the door lock jamb 90. The door lock jamb 90 includes a head end 92 for connecting with a head component of a sliding door assembly, a sill end 98 for connecting with a sill component of a sliding door assembly, and a vertical axis therebetween. In the embodiments shown in FIGS. 9A and 9B, the door lock jamb 90 includes a side surface 93 with section 99 having a surface 97 sufficiently designed for maintaining a vertical weather bar capable of maintaining vertical weather strip gaskets.

Figure 10B:
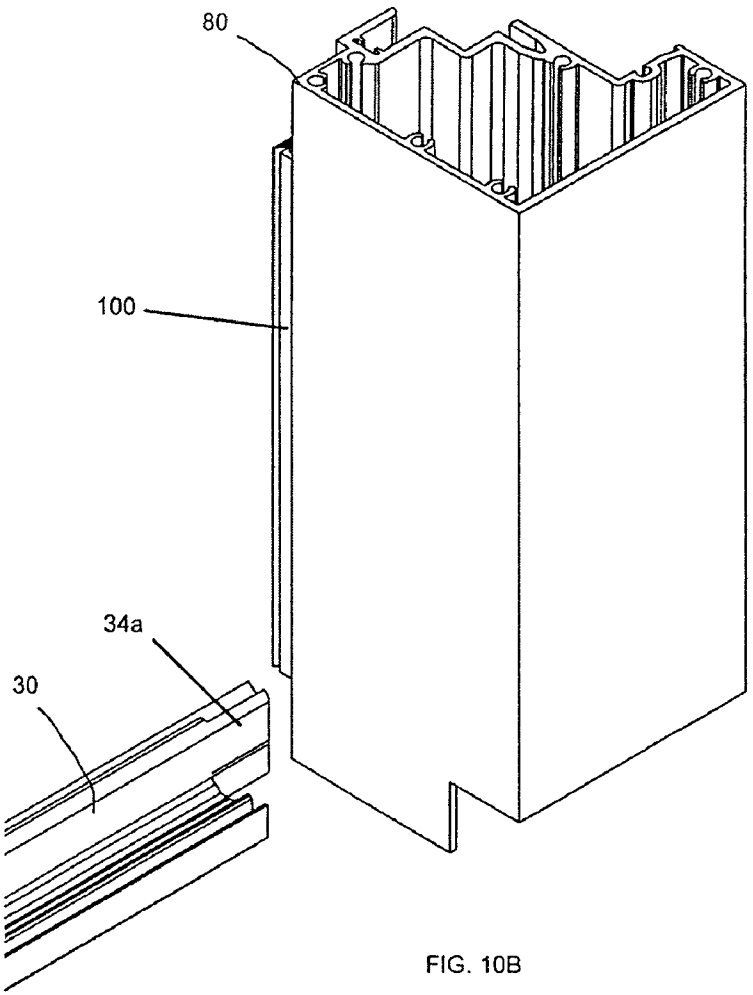
FIGS. 10A and 10B illustrate fragmentary isometric views of the fixed meeting stile of FIG. 8B and the horizontal weather bar of FIG. 3 prior to engaging the horizontal weather bar and the fixed meeting stile.
Figure 10A:
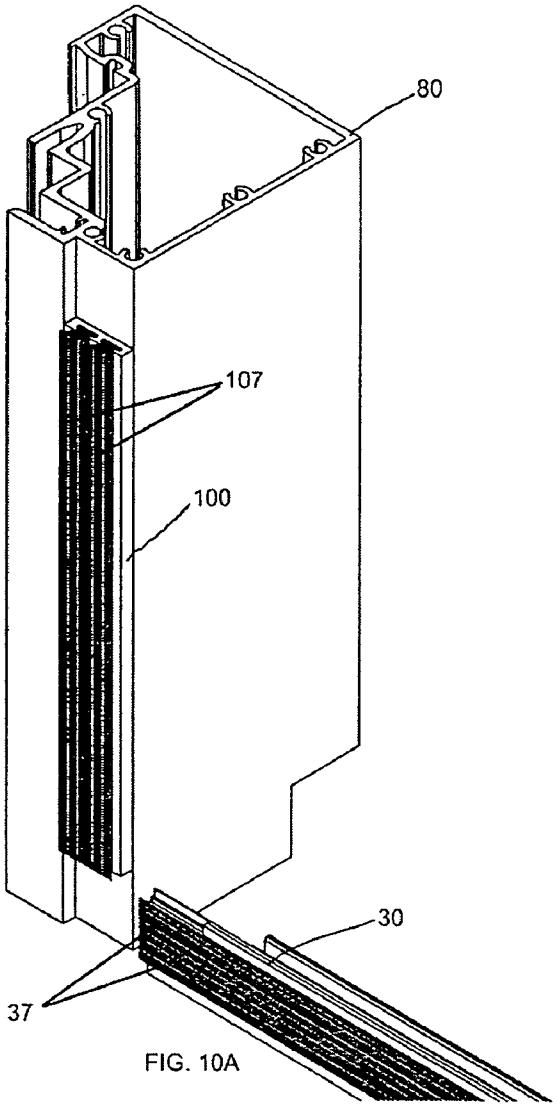
Figure 11B:
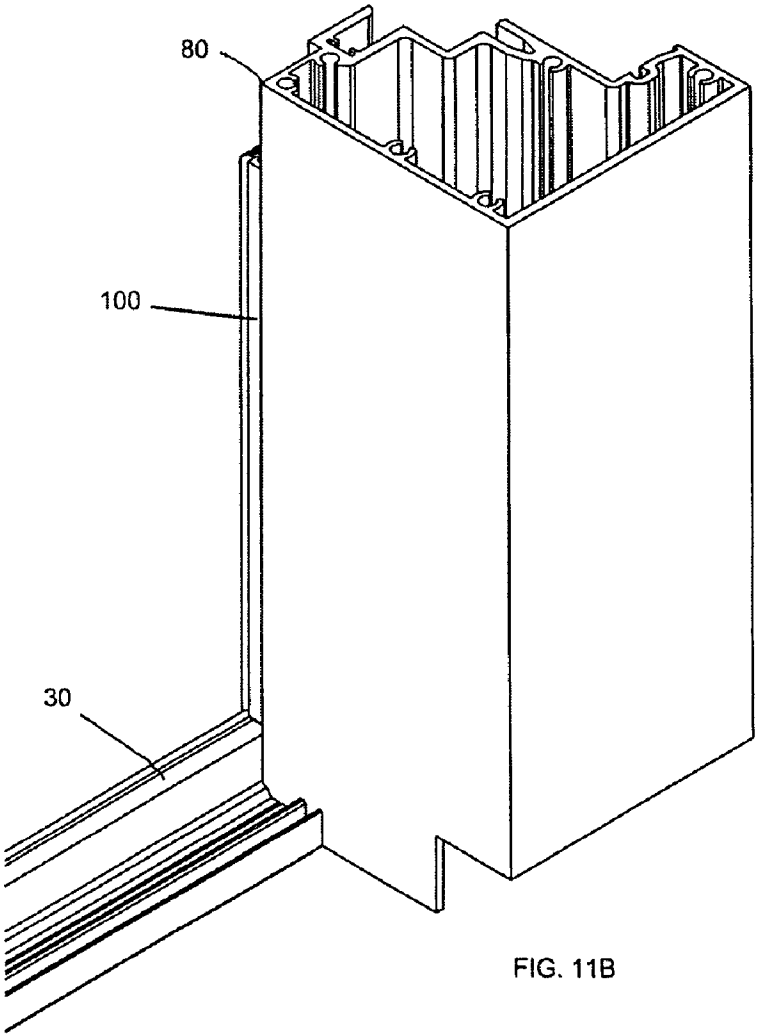
FIGS. 11A and 11B illustrate fragmentary isometric views of the fixed meeting stile of FIG. 8B and the horizontal weather bar of FIG. 3 after engaging the horizontal weather bar and the fixed meeting stile.
Figure 11A:
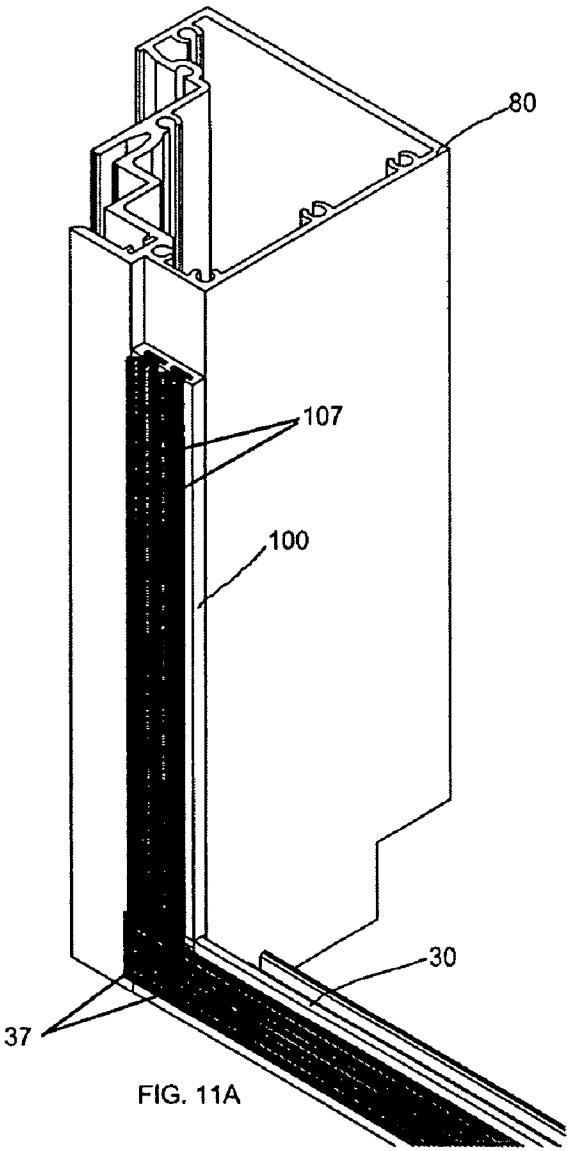

FIGS. 10A and 10B, in conjunction with FIGS. 1A and 11B, illustrate the engagement of the fixed meeting stile 80 and the horizontal weather bar 30. As illustrated in the various figures, vertical weather bar 100 having vertical weather strip gaskets 107 are positioned in the fixed meeting stile 80, and horizontal weather strip gaskets 37 are positioned in the horizontal weather bar 30. FIG. 10A is a fragmentary isometric view of the fixed meeting stile 80 and the horizontal weather bar 30 from the front prior to engagement. FIG. 10B is a fragmentary isometric view of the fixed meeting stile 80 and the horizontal weather bar 30 from the back prior to engagement. FIG. 11A is a fragmentary isometric view of the fixed meeting stile 80 and the horizontal weather bar 30 from the front after engagement. FIG. 11B is a fragmentary isometric view of the fixed meeting stile 80 and the horizontal weather bar 30 from the back after engagement. When the vertical weather bar 100 having the vertical weather strip gaskets 107 are positioned on, or engaged with, the outer surface 83 of the fixed meeting stile 80, and when horizontal weather strip gaskets 37 are maintained in the channels 36 of the horizontal weather bar 30, the vertical weather strip gaskets 107 will abut the top horizontal weather strip gasket 37 forming a protective seal, as illustrated in FIGS. 11A and 11B. In an embodiment, the abutting of the vertical weather strip gaskets 107 and horizontal weather strip gaskets 37 creates a wick-free environment. The ends of the vertical weather strip gaskets 107 will not extend past the horizontal weather strip gaskets 37, thus stopping the possibility of water wicking up the vertical weather strip gaskets 107.

Figure 12B:
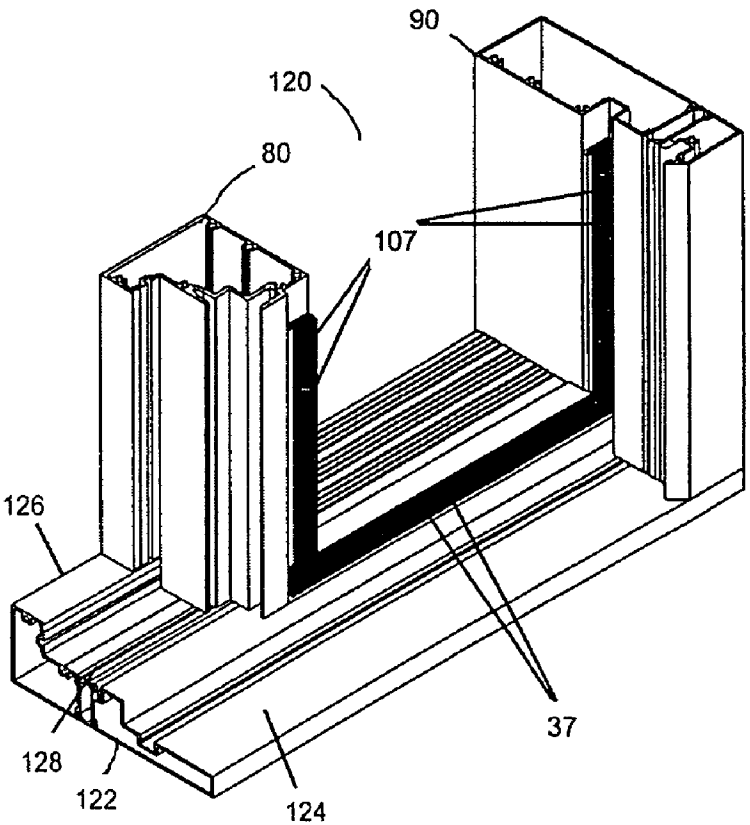
FIGS. 12A and 12B illustrate fragmentary isometric views of an embodiment of a sliding door assembly of the present invention incorporating the fixed meeting stile of FIG. 8B, the door lock jamb of FIG. 9B, and the horizontal weather bar of FIG. 3.
Figure 12A:
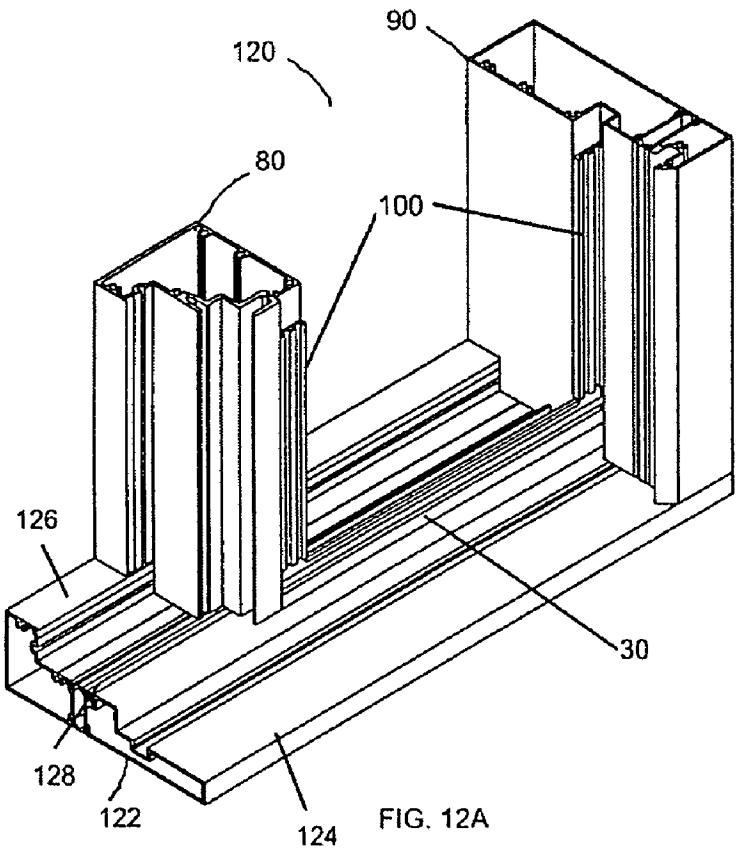

FIGS. 12A and 12B are fragmentary isometric views of a sliding door assembly 120 of the present invention featuring the fixed meeting stile 80, the door lock jamb 90, and the horizontal weather bar 30. FIG. 12A shows the meeting stile 80, the door lock jamb 90, and the horizontal weather bar 30 in position without any weather strip gaskets. FIG. 12B shows the meeting stile 80, the door lock jamb 90, and the horizontal weather bar 30 in position with weather strip gaskets. The sliding door assembly 120 illustrated in FIGS. 12A and 12B have an OX configuration for illustrative purposes only. The fixed meeting stile 80 and the horizontal weather bar 30 of the present invention are not intended to be limited to sliding door units having an OX configuration, as other typical sliding door configurations can be used. The head component of the sliding door assembly 120, as well as the fixed panel door and the sliding panel door are not shown in FIGS. 12A and 12B for simplicity. The sliding door assembly 120 includes a bottom sill component 122 having an operable sill 124 for positioning a moveable door, and a fixed sill 126 for maintaining a stationary door. The fixed sill 126 includes a threshold 126. As illustrated in FIGS. 12A and 12B, horizontal weather bar 30 engages the threshold 128 via attaching means 32. The sill end 88 of the fixed meeting stile 80 is sufficiently designed to engage the first coped end 34*a* of the first horizontal weather bar 30. The first coped end 34*a* of the first horizontal weather bar 30 overlaps the recessed outer surface 83 towards the sill end 88 of the fixed meeting stile 80. Similarly, the sill end 98 door lock jamb 90 is sufficiently designed to engage the second coped end 34*b* of the horizontal weather bar 30. The second coped end 34*b* of the horizontal weather bar 30 overlaps the side surface 93 of the door lock jamb 90 towards the sill end 98 of the door lock jamb 90. Although not illustrated in FIGS. 12A and 12B, a second horizontal weather bar 30 can engage the head component of the sliding door assembly 120 via attaching means 32, such that the second coped end 34*b* of the second horizontal weather bar 30 overlaps the outer surface 83 at the head end 82 of the fixed meeting stile 80. Similarly, the first coped end 34*a* of the second horizontal weather bar 30 overlaps the side surface 93 at the head end 92 of the door lock jamb 90. When a sliding door assembly of the present invention includes a first horizontal weather bar having horizontal weather strip gaskets, a second horizontal weather bar having horizontal weather strip gaskets, a fixed meeting stile having vertical weather strip gaskets, and a door lock jamb having vertical weather strip gaskets, a protective seal is created around the periphery of a sliding door.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A sliding door assembly comprising:

a bottom sill component having a fixed sill for maintaining a stationary door, and an operable sill outwardly of the fixed sill for positioning a sliding door;

a fixed meeting stile fixed to the fixed sill and having an outer surface that maintains at least one vertical weather strip gasket;

a door lock jamb fixed to the fixed sill and the operable sill and having a side surface that maintains at least one vertical weather strip gasket, wherein the outer surface of the fixed meeting stile and the side surface of the door lock jamb are positioned in a same plane; and at least a first horizontal weather bar having a horizontal axis and being distinct from the stationary door and the operable door, the horizontal weather bar comprising:

an attaching means for engaging the bottom sill component, a horizontal member having a first end that engages a portion of the outer surface of the fixed meeting stile, and a second end that engages a portion of the side surface of the door lock jamb, and at least one horizontal weather strip gasket, wherein the vertical weather strip gasket of the fixed meeting stile, the vertical weather strip gasket of the door lock jamb, and the horizontal weather strip gasket of the first horizontal weather bar form a continuous protective seal.

2. The sliding door assembly of claim 1 wherein the at least one vertical weather strip gasket of the fixed meeting stile abuts the at least one horizontal weather strip gasket of the first horizontal weather bar.

3. The sliding door assembly of claim 1 wherein the at least one vertical weather strip gasket of the door jamb abuts the at least one horizontal weather strip gasket of the first horizontal weather bar.

4. The sliding door assembly of claim 1 wherein the outer surface of the fixed meeting stile includes a recessed area at a head end of the fixed meeting stile and a recessed area at a sill end of the fixed meeting stile.

5. The sliding door assembly of claim 1 wherein the side surface of the door lock jamb includes a recessed area at a head end of the door lock jamb and a recessed area at a sill end of the door lock jamb.

6. The sliding door assembly of claim 1 wherein the horizontal member of the first horizontal weather bar includes a first coped end and a second coped end.

7. The sliding door assembly of claim 1 wherein the at least one vertical weather strip gasket of the fixed meeting stile is positioned on a vertical weather bar.

8. The sliding door assembly of claim 1 wherein the at least one vertical weather strip gasket of the door lock jamb is positioned on a vertical weather bar.

9. The sliding door assembly of claim 4 wherein the outer surface of the fixed meeting stile includes at least one channel running vertically between the recessed area at the head end of the fixed meeting stile and the recessed area at the sill end of the fixed meeting stile for engaging the at least one vertical weather strip gasket.

10. The sliding door assembly of claim 5 wherein the side surface of the door lock jamb includes at least one channel running vertically between the recessed area at the head end of the door lock jamb and the recessed area at the sill end of the door lock jamb for engaging the at least one vertical weather strip gasket.

11. The sliding door assembly of claim 6 wherein the first coped end of the first horizontal weather bar engages and overlaps with the outer surface of the fixed meeting stile, and the second coped end the first horizontal weather bar engages and overlaps with the side surface of the door lock.

12. The sliding door assembly of claim 6 wherein the horizontal member of the first horizontal weather bar includes at least one channel running horizontally between the first coped end and the second coped end for engaging the at least one horizontal weather strip gasket.

* * * * *